US005955951A

United States Patent [19]

Wischerop et al.

[11] Patent Number: 5,955,951

[45] Date of Patent: Sep. 21, 1999

[54] COMBINED ARTICLE SURVEILLANCE AND PRODUCT IDENTIFICATION SYSTEM

[75] Inventors: Jérôme Wischerop, Paris, France; David B. Ferguson, Boca Raton, Fla.; Jorge F. Alicot, Davie, Fla.; G. Mark Shafer, Boca Raton, Fla.

[73] Assignee: Sensormatic Electronics Corporation, Boca Raton, Fla.

[21] Appl. No.: 09/065,507

[22] Filed: Apr. 24, 1998

[51] Int. Cl.[6] ..... G08B 13/14

[52] U.S. Cl. ..... 340/572.8; 340/572.1; 340/551; 340/568.1; 340/825.54; 70/57.1

[58] Field of Search ..... 340/572.1, 572.8, 340/551, 568.1, 825.54; 70/57.1, 391, 416, 453, 654; 24/704.1, 704.2

[56] References Cited

U.S. PATENT DOCUMENTS

| | | | |
|---|---|---|---|
| 4,510,489 | 4/1985 | Anderson, III et al. | 340/572 |
| 4,510,490 | 4/1985 | Anderson, III et al. | 340/572.1 |
| 5,005,125 | 4/1991 | Farrar et al. | 705/28 |
| 5,059,951 | 10/1991 | Kaltner | 340/572.3 |
| 5,105,190 | 4/1992 | Kip et al. | 340/825.54 |
| 5,151,684 | 9/1992 | Johnsen | 340/572 |
| 5,426,419 | 6/1995 | Nguyen et al. | 340/572 |
| 5,528,914 | 6/1996 | Nguyen et al. | 70/57.1 |
| 5,535,606 | 7/1996 | Nguyen et al. | 70/57.1 |
| 5,587,703 | 12/1996 | Dumont | 340/572 |

*Primary Examiner*—Benjamin C. Lee
*Attorney, Agent, or Firm*—Robin, Blecker & Daley

[57] ABSTRACT

A combined article surveillance and product identification system is formed of conventional elements, of which some are modified. Included in the system are conventional EAS detection equipment, hard EAS tags with RFID circuitry installed in the hard tag enclosure, a tag detaching device modified to include product data reading and transaction data writing capabilities, and a point-of-sale terminal modified to interact with the detaching device. The point-of-sale terminal triggers operation of the detaching device to separate the hard tag from an article of merchandise in response to data read from the tag by the detaching device and relayed to the point-of-sale terminal.

16 Claims, 8 Drawing Sheets

RFID SYSTEM COMPONENTS

DETACHER / RFID READER / WRITER

RFID CHIP

P.O.S. TERMINAL - DETACHER HANDLING SOFTWARE

SEPARATE CONTROL MODULE FOR DETACHER

COMBINED ARTICLE SURVEILLANCE AND PRODUCT IDENTIFICATION SYSTEM

FIELD OF THE INVENTION

This invention relates to electronic article surveillance (EAS) systems, and also to removable, reusable tags for use in EAS systems.

BACKGROUND OF THE INVENTION

Electronic article surveillance system are well known and are used for purposes of inventory control and to prevent theft and unauthorized removal of articles from a controlled area. Typically, in such systems, a system transmitter and a system receiver are used to establish a surveillance zone which must be traversed by any articles being removed from the controlled area.

An EAS tag is affixed to each article and includes a marker or sensor adapted to interact with a signal that is transmitted by the system transmitter into the surveillance zone. This interaction causes a further signal to be established in the surveillance zone which further signal is received by the system receiver. Accordingly, upon movement of a tagged article through the surveillance zone, a signal will be received by the system receiver, identifying the unauthorized presence of the tagged article in the zone.

Certain types of EAS tags have been designed to be reusable and, thus, include releasable attachment devices for affixing the tags to the articles. Such attachment devices are further designed to be releasable by authorized personnel only so that unauthorized removal of a tag from its article is avoided. To this end, many attachment devices are made releasable only through the use of an associated special tool or detaching mechanism. Examples of detaching units which may be employed to separate reusable, removable EAS tags from articles of merchandise are disclosed in U.S. Pat. Nos. 5,426,419; 5,528,914; and 5,535,606. (The disclosures of these three patents are incorporated herein by reference.) The detaching units disclosed in these patents are designed to operate upon a two-part "hard" EAS tag, formed of a molded plastic enclosure portion which houses EAS marker elements, and a tack or pin member which is inserted through an article of merchandise to be protected (such as an item of clothing) and then also inserted into the enclosure portion of the tag. The enclosure portion of the tag includes a clamp for securely holding the pin in the enclosure portion.

The detaching unit is operated to insert a probe into the enclosure portion of the tag to release the clamp. The pin may then be released from the enclosure portion of the tag, and the tag removed from the article of merchandise. A detaching device which embodies teachings of the '419, '914 and '606 patents is sold by the assignee of this patent application, Sensormatic Electronics Corporation, as Model No. MK200.

One problem that must be faced in connection with removable EAS tags is the possibility of unauthorized removal of the tag from the article of merchandise for the purpose of defeating the EAS system. To prevent unauthorized removal of hard tags, it has been known (as in U.S. Pat. No. 5,005,125, for example) to provide the tags with an alarm arrangement which generates an audible alarm signal upon detection of an attempt to tamper with the enclosure portion of the tag. It is also known to secure detaching units with a lock-and-key arrangement, so that only those having possession of the required key are able to use the detaching units. However, if a store employee with access to the key chooses to participate in an attempt to defeat the EAS system, then unauthorized use of the detaching unit to remove the hard tags from the merchandise may take place.

OBJECTS AND SUMMARY OF THE INVENTION

It is accordingly an object of the invention to prevent unauthorized use of an EAS tag detaching unit.

It is a further object of the invention to provide an article surveillance tag which performs both theft prevention and article identification functions.

It is still a further object of the invention to provide a combined article surveillance and article identification system.

According to a first aspect of the invention, there is provided a detacher apparatus for removing an EAS tag from an article of merchandise, the tag including a first element and a second element, the first and second elements being adapted for assembly together by snap connection through the article of merchandise, the tag further including a release mechanism for selectively releasing the snap connection of the first and second elements and the tag also including a transponder for selectively providing a multibit identification signal, the detacher apparatus including a housing, an indicating device in the housing for indicating that an EAS tag is present at the housing, circuitry responsive to the indicating device for generating an interrogation signal for stimulating the transponder of the EAS tag to provide the multibit identification signal, circuitry for receiving the multibit identification signal provided by the transponder of the EAS tag, and a mechanism, in the housing and responsive to the receiving circuitry, for actuating the release mechanism of the EAS tag to release the snap connection so that the first and second elements may be separated from each other to detach the EAS tag from the article of merchandise. The interrogation signal generating circuitry and the identification signal receiving circuitry may both be within the above-mentioned housing. The transponder of the EAS tag may be arranged to receive and store data signals, and the detacher apparatus may include circuitry for transmitting such data signals to the transponder.

According to a second aspect of the invention, there is provided a detacher for removing a hard EAS tag from an article of merchandise, including a housing which has a top surface and a nesting area in the top surface shaped for receiving the hard tag, a switch at the nesting area for being mechanically actuated by a hard tag inserted into the nesting area, an antenna in the housing for receiving an identification signal from a hard tag inserted in the nesting area, a separation mechanism in the housing for inserting a probe into the hard tag to release a clamp in the hard tag, a control circuit for controlling operation of the separation mechanism, at least one signal port at the housing, and first and second circuits for respectively providing a signal path between the antenna and the at least one signal port, and for providing a signal path between the at least one signal port and the control circuit.

According to a third aspect of the invention, there is provided an electronic article surveillance and article identification system, including, in combination, a detection device, positioned at an exit of a retail store, for detecting unauthorized removal of goods from the retail store; an identification signal reader at a checkout counter in the retail store, the identification signal reader for receiving, via radio communication, identifying information related to goods presented for purchase at the checkout counter; a plurality of reusable EAS/ID tags for being removably attached to goods on sale at the retail store, each of the EAS/ID tags including a marker element for triggering the detection device to generate an alarm signal and an identification element, separate from the marker element, for providing identifying information to the identification signal via radio communication; and a detacher device at the checkout counter for removing the EAS/ID tags from the goods presented for purchase.

According to a fourth aspect of the invention, there is provided a combined EAS/article identification tag, including an enclosure, a mechanism for removably securing the enclosure to an article of merchandise, a marker element housed in the enclosure, for triggering an article surveillance system to generate an alarm signal, and an identification circuit, housed in the enclosure and separate from the marker element, for generating a multibit radio frequency identification signal. According to a preferred embodiment of the combined EAS/article identification tag, the marker element is an amorphous magnetostrictive strip mounted in proximity to a bias magnet for operation with a conventional magnetomechanical EAS system which generates a 58 kHz interrogation signal, and the identification circuit generates the multibit radio frequency identification signal by modulating a 13 MHz interrogation signal. The magnetostrictive element and the bias magnet may be replaced with other conventional EAS marker elements, such as a so-called "pinned wall" or other type of harmonic marker strip, or a radio frequency or microwave marker element.

According to a fifth aspect of the invention, there is provided, in combination, a point-of-sale terminal, a bar code reader, an EAS tag detaching device, a first signal connection for providing a signal path for transmitting bar code data from the bar code reader to the point-of-sale terminal, a second signal connection for providing a signal path for transmitting a trigger signal from the point-of-sale terminal to the EAS tag detaching device, and a trigger mechanism, associated with the EAS tag detaching device, for actuating the detaching device to remove a reusable EAS tag from an article of merchandise in response to the trigger signal transmitted via the second signal connection.

According to a sixth aspect of the invention, there is provided a detacher for removing an EAS tag from an article of merchandise, the EAS tag including a first element and a second element, the first and second elements being adapted for assembly together by snap connection through the article of merchandise, the EAS tag further including release means for selectively releasing the snap connection, the detacher including a housing, a movable probe mounted in the housing for selectively actuating the release means of the EAS tag to release the snap connection so that the first and second elements may be separated from each other to detach the EAS tag from the article of merchandise, and a trigger mechanism in the housing for receiving a trigger signal generated by a device that is separate from the detacher apparatus, the trigger mechanism actuating movement of the probe in response to receiving the trigger signal.

In an EAS/product identification system provided in accordance with the invention, the tag detaching unit is made subject to control by an external device, such as a point-of-sale terminal, so that wrongful or unauthorized use of the tag detacher to remove tags from articles of merchandise is inhibited or prevented.

BRIEF DESCRIPTION OF THE DRAWINGS

The above and other features, aspects, and advantages of the present invention will become more apparent upon reading the following detailed description in conjunction with the accompanying drawings, in which.

DETAILED DESCRIPTION

Figure 1:
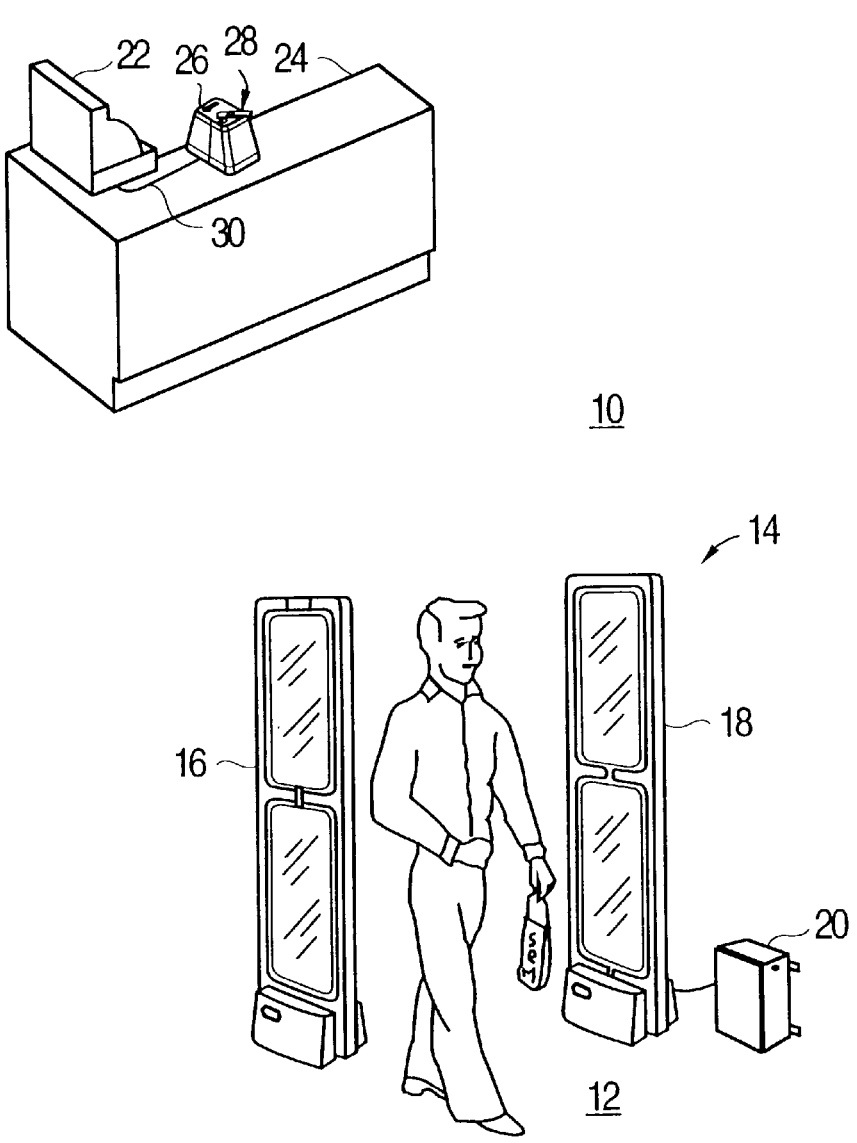
FIG. 1 pictorially illustrates a combined article surveillance and article identification system provided in accordance with the invention.

FIG. 1 pictorially illustrates elements of a combined article surveillance and article identification system provided in accordance with the invention and installed at a retail store 10. At an exit 12 of the retail store, conventional EAS detection equipment is positioned, generally indicated by reference numeral 14. The EAS detection equipment 14 includes antenna pedestals 16 and 18 and receiver/detection electronics 20. Preferably the EAS detection equipment 14 is of the type used in magnetomechanical EAS systems and sold by the assignee of the present application under the trademark "ULTRA*MAX", although use of other types of EAS equipment is contemplated.

A point-of-sale terminal 22 is installed at a checkout counter 24. Also present at the checkout counter 24 is a detaching unit 26 which is operable to remove a reusable EAS/ID tag 28 from an article of merchandise (which is not shown). As will be discussed below, the detaching unit 26 also functions as a data reader and writer with respect to the tag 28. Indicated at 30 is a data signal connection provided between the detaching unit 26 and the point-of-sale terminal 22. The point-of-sale terminal 22 is preferably a conventional item, which operates in accordance with customary practices for point-of-sale terminals, except for a limited software modification which will be described below.

Figure 2:
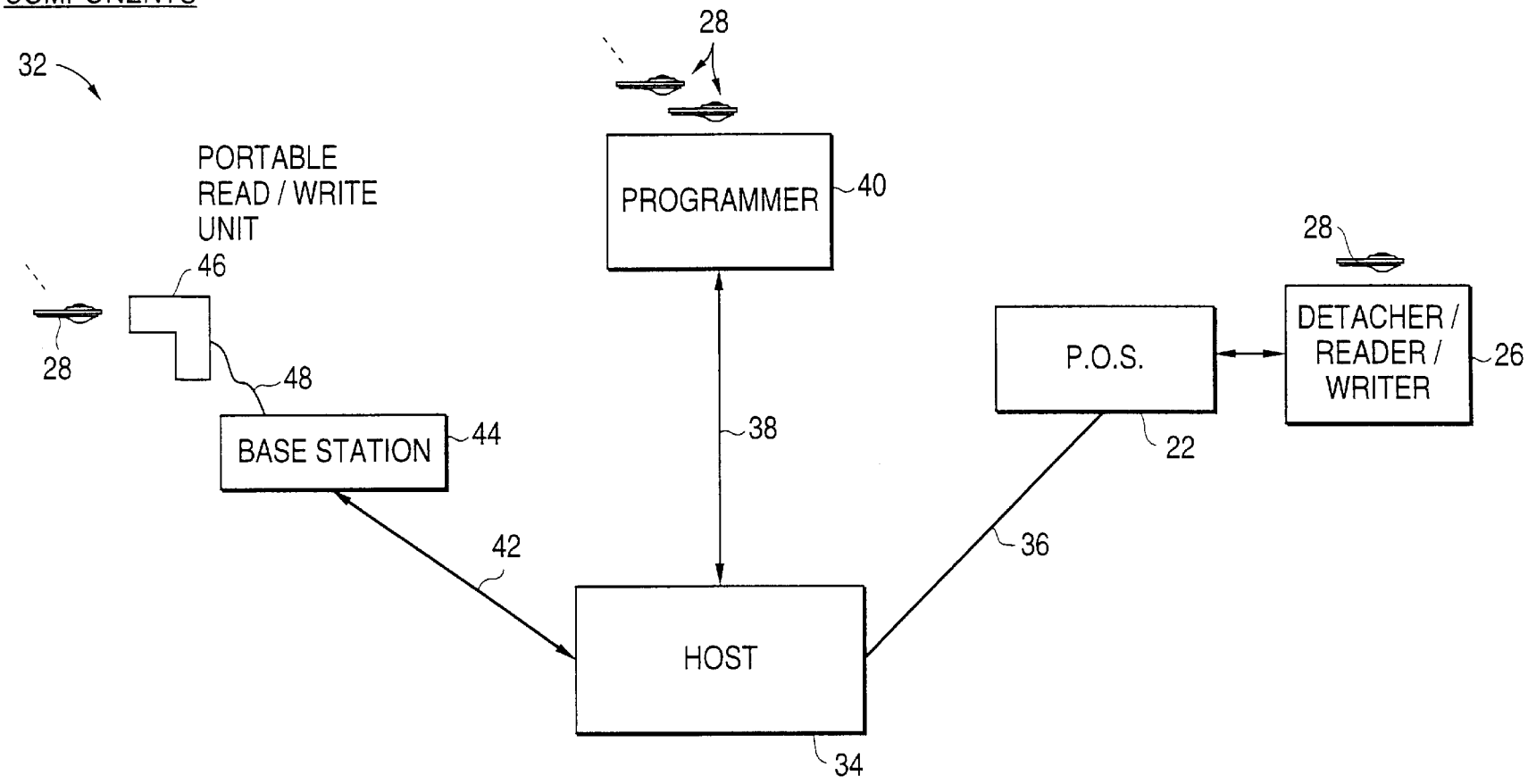
FIG. 2 is a block diagram of article identification system aspects of the combined system of FIG. 1.

FIG. 2 illustrates a data network 32 which links components of the system provided in accordance with the invention.

Reference numeral 34 represents a host computer, which stores merchandise identification, inventory, pricing, and other data. A data signal path 36 allows for two-way data communication between the host computer 34 and the above-mentioned point-of-sale terminal 22. A second data path 38 permits data communication between the host computer 34 and a programming unit 40. The function of the programmer 40 is to write product identifying data and other information into EAS/ID tags 28. An additional data signal path 42 permits data communication between host computer 34 and a base station 44 for a portable read-write unit 46. As indicated at 48, a wireless data link permits data to be exchanged between the portable unit 46 and the base station 44. (Alternatively, the base station may include a docking station to allow the portable unit to be connected by direct contacts or another communication link with the base station.)

The function of the portable unit 46 is to read data from tags 28, e.g. for the purpose of taking inventory. The unit 46 preferably also has the capability to write data into the tags 28. For example, the portable unit 46 may be employed to write data into tags 28 at the time when the tags are applied to items of merchandise.

Although only one each of the point-of-sale terminal 22, the programming unit 40 and the portable unit 46 are shown in FIG. 2, it is to be understood that additional POS terminals, programming units and portable read/write units may be included in the system and joined by respective data links to the host computer 34.

Figure 3:
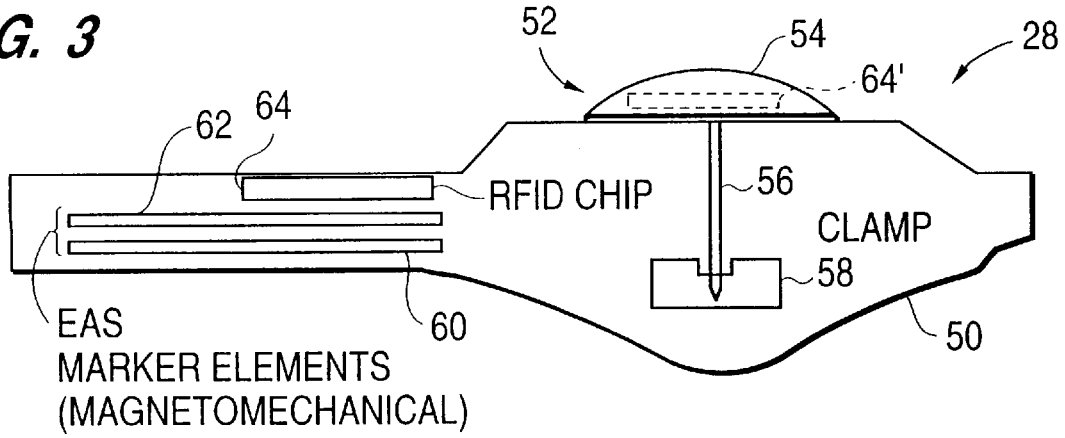
FIG. 3 is a schematic cross-sectional view of a combined article surveillance and article identification tag used with the system of FIG. 1.

FIG. 3 is a schematic cross-sectional view of an EAS/ID tag provided in accordance with the invention, and shows salient features of the tag 28. The largest component of the tag 28 is an enclosure 50, which is at least partially hollow and is preferably formed of molded plastic. A removable tack or pin portion 52 includes a head 54 and a pointed shaft 56 which is inserted into a recessed hole in the enclosure portion 50 and is held by a clamping mechanism 58 mounted in the enclosure portion 50. Housed within the enclosure portion 50 are a magnetostrictive active EAS element 60 and a bias magnet 62. The elements 60 and 62 are preferably like those conventionally employed in magnetomechanical EAS markers, and may be like the corresponding elements disclosed in U.S. Pat. No. 4,510,489. The above-referenced "ULTRA*MAX" magnetomechanical EAS system operates at a standard frequency of 58 kHz, and it is preferred that the resonator element 60 and bias element 62 be selected such that the resonator element has a resonant frequency of substantially 58 kHz. As is known to those who are skilled in the art, conventional magnetostrictive active elements are formed from thin, ribbon-shaped strips of substantially completely amorphous metal-metalloid alloy. In accordance with conventional practice, the bias magnet 62 may be formed of a "semi-hard" or "hard" ferromagnetic material, but it is preferred that a "hard" material be used, because the tag is not intended to be deactivatable and it is therefore desirable that the bias magnet remain in a stable magnetized condition over a long period of time. ("Semi-hard" materials are those having a coercivity in the range of about 10 to 500 Oe; "hard"0 materials have a coercivity of about 500 Oe or greater.)

Also housed within the enclosure portion 50 of the tag 28 is an RFID chip 64. The RFID chip 64 is capable of storing multi-bit identification data and emitting an identification signal corresponding to the stored data in response to a radio frequency interrogation signal. The RFID chip 64 functions as a transponder in connection with article identification aspects of the article surveillance/identification system disclosed herein. One example of a device which is suitable for service as the RFID chip is the model 210 transponder circuit available from Gemplus, Z. I. Athélia III, Voie Antiope, 13705 La Ciotat Cedex, France. The Gemplus transponder operates at 13 MHz and has considerable data storage capability (well over a thousand characters). This particular transponder circuit is "passive" in the sense that it is powered by the interrogation signal and does not require a battery.

It is preferred that, except for the incorporation of the RFID chip 64, the tag 28 be constituted as a conventional reusable/removable EAS "hard tag". An item that is suitable for modification to provide the tag 28 of the invention, simply by incorporating an RFID chip, is the magnetomechanical hard tag sold by the assignee of the present application under the trademark "SUPERTAG".

As an alternative to housing the RFID transponder in the enclosure portion of the tag, it is contemplated to lodge the RFID transponder in the head 54 of the tack 52, as shown in phantom at 64' in FIG. 3.

The preferred combination of an active EAS element that operates at 58 kHz and an RFID transponder that operates at 13 MHz is desirable because the two operating frequencies are well separated from each other. Consequently, the EAS and product identification aspects of the system disclosed herein do not interfere with each other. Further, the 13 MHz operating frequency of the transponder is high enough for the transponder to be quite small in size, so as to fit in existing hard tag enclosures. Moreover, the 13 MHz operating frequency is low enough to minimize human body shielding or detuning of the transponder. The selected identification system operating frequency also provides sufficient bandwidth for the data transmission operations described herein. At the same time, applicable spectrum management regulations permit operation at the selected frequency with sufficient power levels for the purposes of the system disclosed herein.

Figure 4:
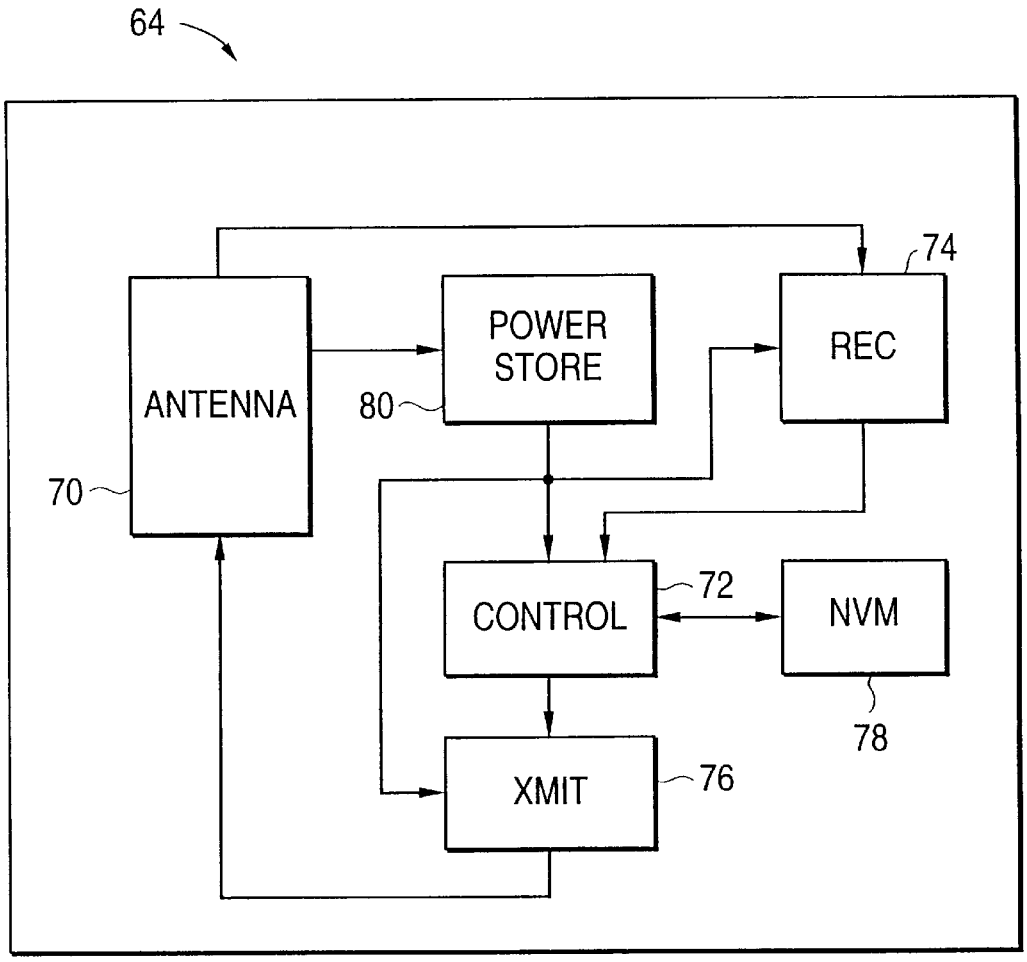
FIG. 4 is a block diagram representation of an RFID chip included in the tag of FIG. 3.

FIG. 4 is a block diagram showing major components of the RFID chip 64. Included in the RFID chip is an antenna structure which is tuned to receive a signal that is at the operating frequency of the article identification system. For example, the operating frequency to which the antenna structure 70 is tuned may be 13 MHz. A control circuit 72 controls the overall operation of the RFID chip. Connected between the antenna 70 and the control circuit 72 is a receive circuit 74, which functions to capture data signals carried by the carrier signal to which the antenna 70 is tuned. In a preferred embodiment of the system, the data signal is generated by an article identification system transmitter (possibly integrated with a tag detaching device, as discussed below) by on/off keying of the carrier signal, and the receive circuit is arranged to detect and capture the on-off keyed data signal.

Also connected between the antenna 70 and the control circuit 72 is a transmit circuit 76. Under control by the control circuit 72, the transmit circuit 76 operates to transmit a data signal via the antenna 70. In a preferred embodiment of the RFID chip, the transmit circuit selectively opens or shorts a reactive element (not separately shown) in the antenna structure 70 to provide perturbations in the interrogation signal which are detectable by an article identification system data reader (which also may be integrated with the tag detaching device).

Associated with the control circuit 72 is a non-volatile memory 78 which stores data under control of the control circuit 72, and selectively provides stored data to the control circuit 72. The non-volatile memory 78 is preferably used to store identification data which is accessed by the control circuit 72 and used to drive the transmit circuit 76 so that the identification data is output by the RFID chip as an identification signal. Data to update the identification data stored in the non-volatile memory 78 (or additional data indicative of characteristics of the article of merchandise to which the EAS/ID tag is attached, or indicative of handling or sale of the article of merchandise) may be received via the receive circuit 74 and stored in the non-volatile memory 78 by the control circuit 72.

Also included in the RFID chip 64 is a power storage circuit 80 which is connected to the antenna structure 70 and accumulates power from a signal induced in the antenna structure 70 by an interrogation signal applied to the RFID chip. The power storage circuit 80 may include, for example, a storage capacitor (not separately shown). The power storage circuit 80 supplies the power required for operation of the RFID chip.

Figure 5:
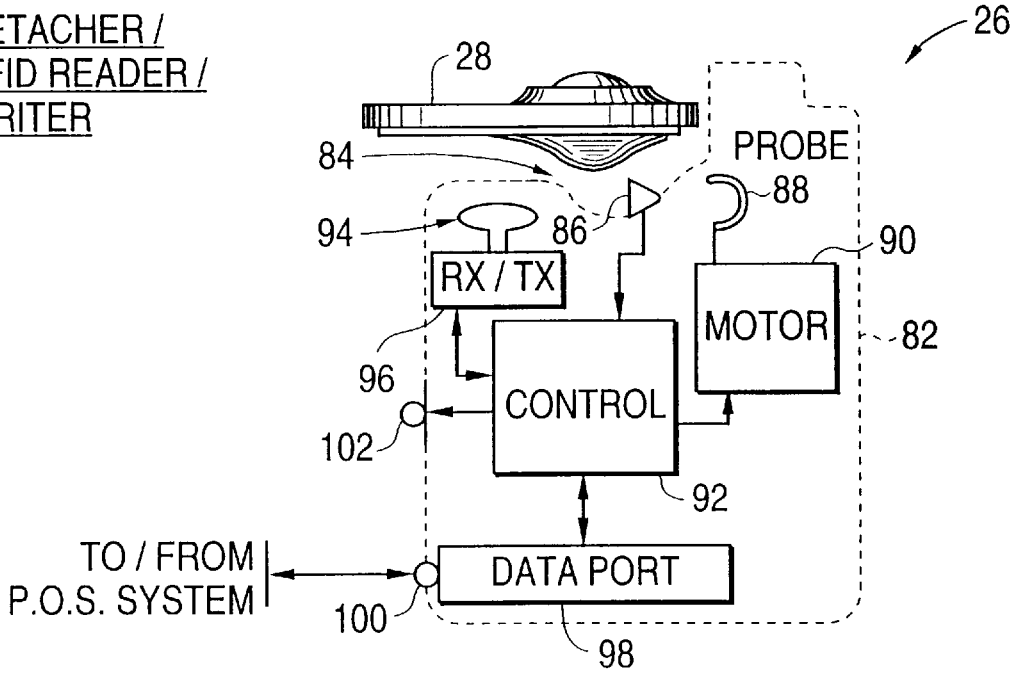
FIG. 5 is a partly schematic cross-sectional, and partly block diagram, representation of a detacher/data read and write unit that is part of the system of FIG. 1.

FIG. 5 shows, in schematic terms, details of the detaching unit 26. The unit 26 includes a housing 82, schematically indicated by dashed lines in the drawing.

At a top surface of the housing 82 there is provided a nesting area 84 which is shaped and sized to receive one of the EAS/ID tags referred to above. (In the drawing, one of the tags 28 is shown in a position proximate to the nesting area 84.) A mechanically actuatable switch 86 is mounted in the nesting area 84 to provide an indication that a tag 28 has been positioned in the nesting area 84. Although only one tag detection switch 86 is shown in FIG. 5, it should be understood that at least one additional tag detection switch may be mounted at the nesting area 84, as in the detacher devices of the above-referenced '419, '914, and '606 patents.

The mechanical components of the detaching unit 26, including the housing 82 and the nesting area 84 may be like the corresponding elements of a detacher device marketed by the assignee of the present application, Sensormatic Electronics Corporation, as Model No. MK200, and/or as disclosed in above-referenced U.S. Pat. Nos. 5,426,419; 5,528,914; and 5,535,606. Thus, the probe 88 shown in FIG. 5 may be like the arcuate probe of the above referenced detacher device MK200 and the above-referenced patents, and selectively actuatable by a motor 90 for being inserted into the enclosure portion 50 (FIG. 3) of a tag 28 positioned in the nesting area 84 to release the clamping mechanism 58 of the tag so that the pin portion 52 of the tag may be separated from the enclosure portion 50. It will be appreciated that both the probe 88 and the motor 90 are mounted within the housing 82 of the detaching unit 26.

Referring once more to FIG. 5, a control circuit 92 is mounted within the housing 82. The control circuit 92 may include a conventional microprocessor or microcontroller, with associated program and working memory. The control circuit 92 is connected to control operation of the motor 90, and also receives from the switch 86 a signal to indicate the presence in the nesting area 84 of the tag 28. The control circuit 92 also is operable to interrogate (read) the RFID transponder included in the tag 28, and to write data into the RFID transponder. For this purpose, an antenna 94 is provided in the housing 82 and adjacent to the nesting area 84, and receive/transmit circuitry 96 is provided to interconnect the antenna 94 with the control circuit 92. The antenna 94 is positioned and the receive/transmit circuitry 96 arranged so that the effective range of the unit 26 for reading or writing RFID data is limited to cover only a tag which is in the nesting area 84. This substantially eliminates any problem of interference from other tags that may be present at the checkout counter.

The antenna 94 and the receive/transmit circuitry 96 are arranged to operate at a frequency compatible with the RFID transponder of the tag 28; in the preferred embodiment referred to above, the operating frequency is 13 MHz and an interrogation signal which causes the transponder to output its identification signal is a continuous wave at the operating frequency.

The control circuit 92 is also interfaced via circuitry 98 to a port 100 at the housing 82, so that data signals, command signals and the like may be exchanged between the control circuit 92 and the point-of-sale terminal 22 (FIG. 1). Also present on the housing 82 is a warning lamp 102 which is selectively illuminated by the control circuit 92 to warn of an error condition.

Operation of the detaching unit will now be described with reference to FIG. 6, which is a flow-chart illustration of software which controls the control circuit 92 (FIG. 5).

Figure 6:
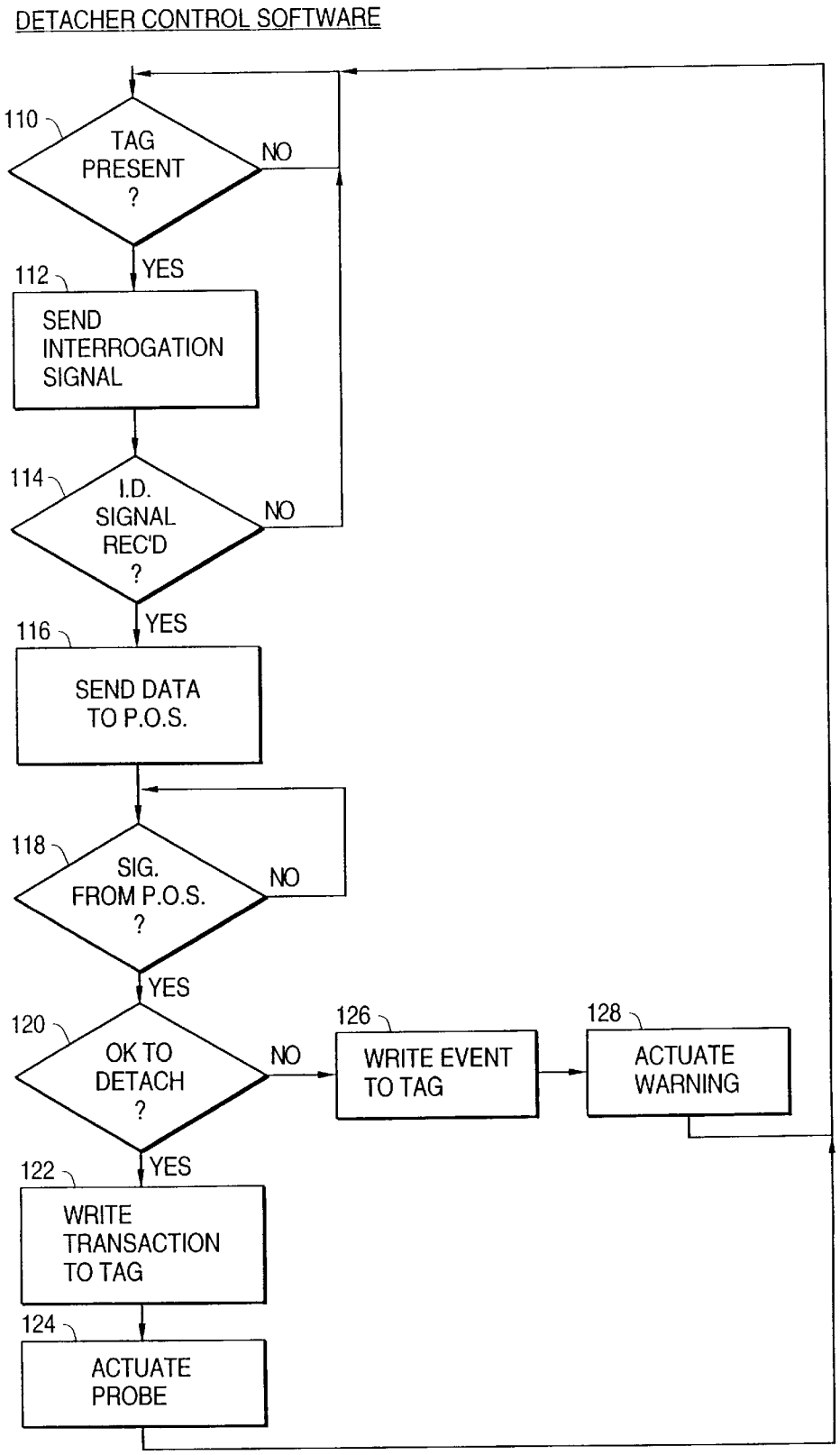
FIG. 6 is a flow chart illustrating software which controls the detacher/read/write unit of FIG. 5.

In FIG. 6, a first step in the process is a determination, represented by block 110, as to whether an EAS/ID tag has been placed in the nesting area 84 of the detaching device 26. As will be understood from previous discussion, the presence of a tag in the nesting area is indicated by a signal provided by the switch 86 which is mechanically actuated by placement of the tag in the nesting area. When the signal indicating the presence of the tag is received, the process advances to step 112, at which the control circuit 92 operates to cause the receipt/transmit circuitry 96 and the antenna 94 to transmit an interrogation signal to stimulate the RFID transponder of the tag to generate an identification signal. It is next determined, at step 114, whether the identification signal from the tag is received. If not, the process loops back to step 110. However, when the identification signal is received, the control circuit 92 forwards the identifying data to the point-of-sale terminal (step 116) and then waits to receive a signal from the point-of-sale terminal (step 118).

Once a signal from the point-of-sale terminal has been received, the process advances to step 120, at which it is determined whether the point-of-sale terminal has indicated that the detaching unit should operate to remove the tag from the article of merchandise. As will be seen, if the point-of-sale terminal determines that the proposed sale is a valid transaction, it will transmit to the detaching unit a signal indicating that the detaching unit should proceed to remove the EAS/ID tag. This signal will sometimes be referred to as a "trigger signal". If the trigger signal is received by the detaching unit, step 122 follows step 120. At step 122, the control circuit 92 causes the receive/transmit circuit 96 and the antenna 94 (FIG. 5) to transmit data to the RFID transponder of the EAS/ID tag to indicate that the article of merchandise to which the tag is attached has been sold. The data written to the RFID transponder may include, for example, date and time of sale, sale price, an indication as to whether the sale was for cash, check or credit card, credit card number and/or authorization number (if appropriate), location and/or identification number of point-of-sale terminal, identifying information for the sales associate carrying out the transaction, etc. It will be appreciated that some or all of this data may have been generated at the point-of-sale terminal (or upstream, at a host computer) and transferred to the detaching device 26.

Following step 122 is step 124, at which the control circuit 92 causes the motor 90 to insert the probe 88 into the tag to release the connection between the pin and enclosure portions of the tag. The tag can then be removed from the article of merchandise and the transaction is complete.

If at step 120 the point-of-sale terminal did not indicate that the tag was to be removed from the article of merchandise, then step 126 follows step 120. At step 126, the control circuit 92 writes data into the RFID transponder of the tag, via receive/transmit circuitry 96 and antenna 94, to indicate that an unauthorized transaction has been attempted. Information indicative of the date, time, location, etc. of the attempted transaction may be included in the data written to the RFID transponder.

Following step 126 is step 128, at which the control circuit 92 illuminates the warning lamp 102 to indicate that removal of the tag is not authorized and will not be carried out by the detaching unit. The process then moves back to step 110 without actuating the probe to release the pin portion of the tag from the enclosure portion of the tag.

Operation of the RFID chip 64 incorporated in the EAS/ID tag will now be described with reference to FIG. 7, which illustrates in flow-chart form software which controls the control circuit 72 (FIG. 4) of the RFID chip.

Figure 7:
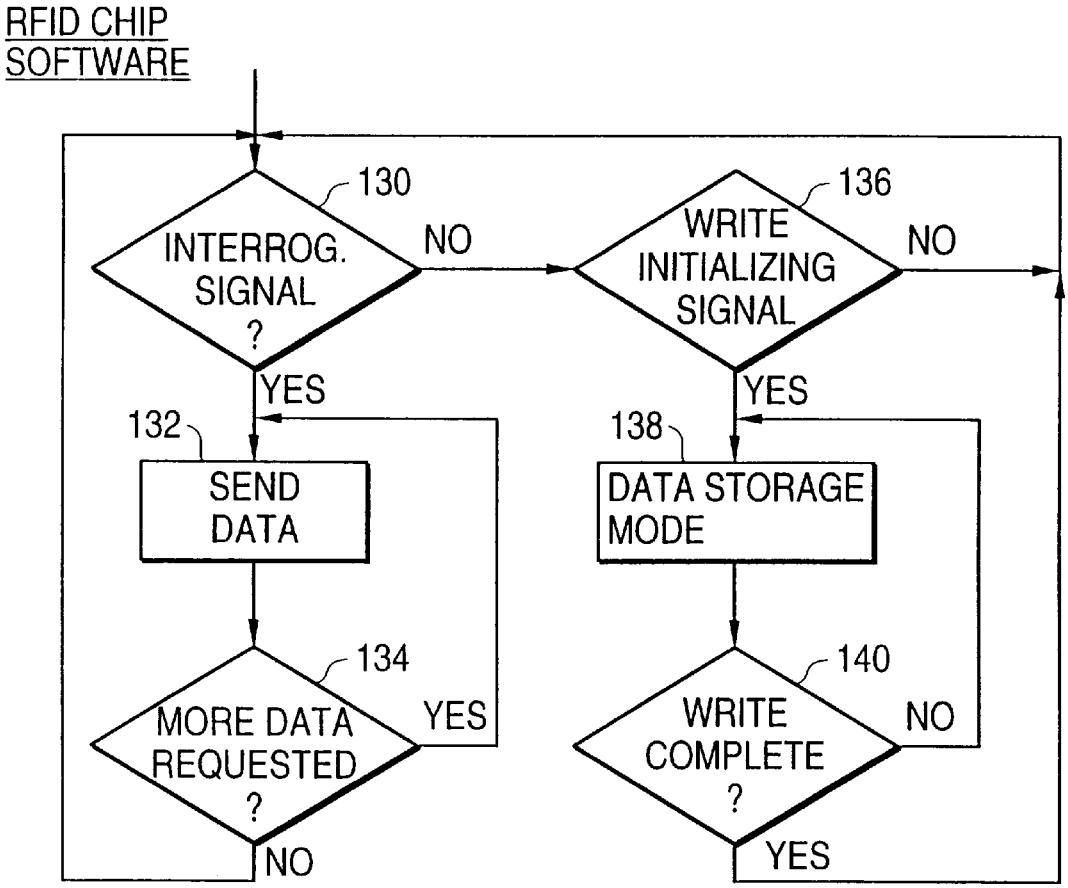
FIG. 7 is a flow chart of software which controls operation of the RFID chip of FIG. 4.

In FIG. 7, it is initially determined whether an interrogation signal is received (step 130). If so, the control circuit 72 retrieves tag ID data from the non-volatile memory 78 and transmits that data as an identification signal by means of transmit circuit 76 and antenna 70 (step 132). As noted before, the data signal may be generated by selectively shorting a reactive element in the antenna so as to form perturbations in the interrogation signal that may be detected by the detaching unit. Following step 132, it is determined whether a signal has been received indicating that additional data is to be transmitted by the RFID chip (step 134). If so, the process loops back to step 132 and the requested additional data is transmitted by the RFID chip. When no more data is requested, the process loops back to step 130.

If at step 130 no interrogation signal was noted, the process advances to step 136, at which it is determined whether a signal is received to indicate that data is to be written into the RFID chip. If such a signal is detected at step 136, then the control circuit 72 enters into a data storage mode (step 138) in which the control circuit receives a data signal via the antenna 70 and the receive circuit 74. The received data signal is stored by the control circuit 72 in the non-volatile memory 78. A preferred embodiment of the RFID chip may include sufficient capacity to store 1,000 to 2,000 characters of information. The information may include transaction identifying information, or information indicative of an unauthorized attempt to remove the tag, as was discussed above in connection with FIG. 6.

Following step 138 is step 140, at which it is determined whether the operation of writing data into the RFID chip has been completed. If not, the process loops back to step 138. But when the data writing operation is complete, the process loops back to step 130.

Figure 8:
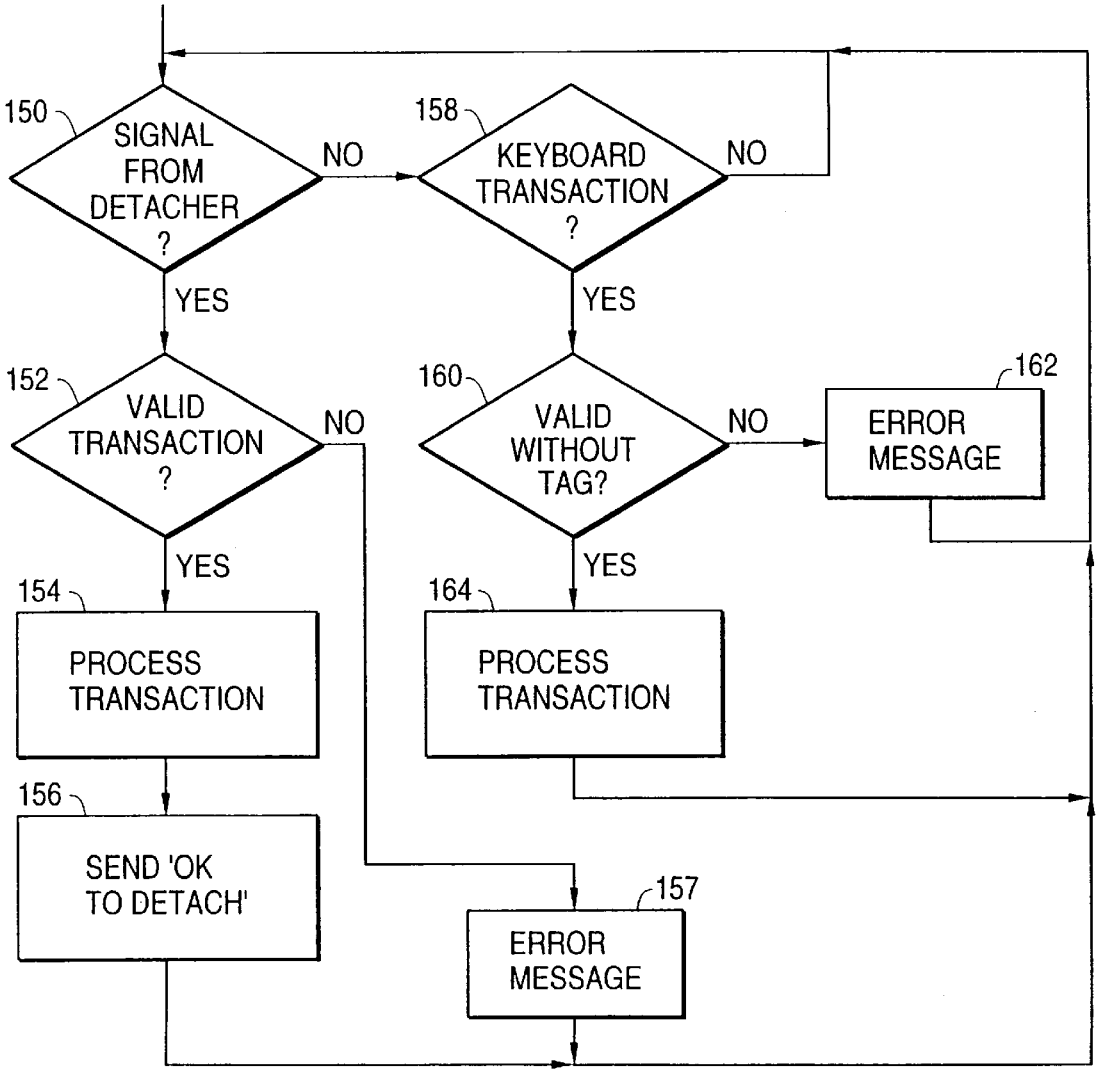
FIG. 8 is a flow chart which illustrates a software routine for a point-of-sale terminal that is part of the system of FIG. 1.

FIG. 8 is a flow chart which illustrates a software modification that may be made to the point-of-sale terminal 22 so that the point-of-sale terminal interacts, in accordance with the invention, with the detaching unit. It is to be understood that the point-of-sale terminal is preferably of conventional construction, and is controlled by a microprocessor which is in communication with a host computer via a communication network. Except for the software module to be described below in connection with FIG. 8, the point-of-sale terminal may operate in a conventional manner to handle merchandise checkout transactions, validate credit card transactions, and exchange data with the host computer.

In the software module illustrated in FIG. 8, a first step 150 indicates a determination as to whether the point-of-sale terminal has received, from the detaching unit, data indicative of the identity of an EAS/ID tag present at the detaching unit (and presumably attached to an item of merchandise). When such a data message is received by the point-of-sale terminal, it is then determined, at step 152, whether the data represents a valid identification number known to be attached to an article of merchandise available for sale. The determination indicated in step 152 may be based upon information previously stored in the point-of-sale terminal, or accessed from the host computer or another device to which the point-of-sale terminal is connected via a data network. If at step 152 it is found that the identification data received from the detaching unit represents a valid transaction, then the point-of-sale terminal proceeds to process a sale transaction (step 154). The point-of-sale terminal processes the sale transaction in a conventional manner, which may include displaying price and item information, validating a credit card, printing a sales receipt, and reporting the sale transaction to the host computer.

Following step 154 is step 156, at which the point-of-sale terminal 22 sends to the detaching unit 26 a signal (the "trigger" signal) to indicate that the detaching unit should proceed to detach the EAS/ID tag from the article of merchandise. Following step 156 the process loops back to step 150.

If it is determined at step 152 that the data received from the detaching unit does not represent a valid transaction, then the process advances to step 157. At step 157 an error message is generated and the process loops back to step 150, without issuing any instruction to the detaching unit to remove the EAS/ID tag from the article of merchandise.

It can be seen that the point-of-sale terminal exercises control over tag removal, and causes the detaching unit to remove the tag from the article of merchandise only if the product identification data received from tag (via the detaching unit) indicates that the proposed transaction is authorized.

If at step 150 no tag identification signal was received from the detaching unit, then the process advances from step 150 to step 158. At step 158, it is determined whether input is received from the keyboard of the point-of-sale terminal to indicate that a transaction is to be performed. If not, the process simply loops back to step 150. However, if keyboard input to initiate a transaction is received in the absence of a tag ID signal reported by the detaching unit, then step 160 follows step 158. At step 160, it is determined whether the transaction requested via the keyboard is of a type that is authorized in the absence of a tag ID signal. If not, an error message is generated (step 162) and the process loops back to step 150 without consummating the proposed transaction. However, if at step 160 it is found that the transaction initiated through the keyboard can properly take place without a tag identification signal having been received from the detaching unit (e.g., the item is not subjected to EAS tagging, or the tag in use does not include ID capability), then the point-of-sale terminal proceeds to process the transaction in the normal course (step 164).

In accordance with the above discussion, the present invention contemplates a combination of electronic article surveillance and product identification functions in a system which includes removable and reusable hard tags which incorporate both EAS elements and an RFID transponder circuit. Other elements of the system include conventional EAS detection equipment placed at one or more store exits, a hard tag detaching device which is able to read data from and write data into the hard tag, and which operates to detach the hard tag only in response to instructions from a point-of-sale terminal to which the detacher is connected via a data signal path. The point-of-sale terminal operates in a conventional fashion as part of a data network including a host computer and retail information database. In addition, the point-of-sale terminal interacts with the detaching unit to receive product identification information read by the detaching unit, and to control tag detaching operations by the detaching unit.

The EAS/product ID system of the present invention promotes efficient operation at the checkout counter. Since the tag detaching and product data entry functions are integrated in a single unit (the detaching unit disclosed herein), the sales associate is relieved of product data entry or bar code scanning as a separate function from EAS tag removal. Moreover, as indicated at the outset of the application, by subjecting the tag detaching unit to control by the point-of-sale terminal, the security of the EAS system as a whole is enhanced by preventing wrongful or unauthorized removal of EAS tags by use of the detaching unit.

Another advantage of the combined article surveillance/product identification system as disclosed herein is that major elements of the system may be entirely conventional items, and the remaining elements may be constituted by making relatively limited modifications to conventional items. In particular, the EAS detection equipment may be completely unchanged from conventional detection equipment. For the hard tags themselves, the only modification required is the addition of a self-contained RFID chip positioned in the tag enclosure portion in space shared with conventional EAS marker elements. The point-of-sale terminal need only undergo a minimal amount of additional programming. Advantageously, the point-of-sale terminal will receive the product identification information from the tag detaching unit in essentially the same manner that such information is received from conventional bar code reading equipment. The only modification required in the point-of-sale terminal entails installation of software to cause the terminal to generate a control signal to trigger the detaching unit when the transaction is found to be valid.

The modifications required for the detaching unit disclosed above, as compared to conventional detachers, are more significant, but not unduly extensive. The housing and mechanical moving parts need not be changed in any way. The relatively significant modifications consist of (a) adding a control circuit responsive to a data or command signal generated from outside the detaching mechanism, so that a detaching operation does not proceed automatically without external input, as in prior detaching devices; and (b) providing data reading and writing circuits integrated within the detaching device, for communication with the RFID transponder of the EAS/ID tag. These modifications can be accomplished without a major redesign of the detaching unit as a whole.

Since the combined article surveillance/product identification system of the present invention relies primarily on existing equipment and limited modifications thereof, the system can be readily introduced into retail operations without major expenditures for installation of new equipment. Adoption of the complete system as disclosed herein may utilize existing installations of EAS detection equipment, as well as currently installed point-of-sale terminals, with a minor software update. Conventional detaching units and conventional hard tags may be readily replaced with the detaching units and EAS/ID tags disclosed herein to bring the entire system into operation in accordance with the principles of the present invention.

The present invention has a variety of aspects which, when combined together, form the complete system disclosed herein, but a number of these aspects may be utilized separately from others. To give one example, it is not necessary that the detaching unit include data reading and writing circuitry nor that the EAS tag have an RFID transponder included therein. It is consistent with the principles of the invention that a conventional tag detaching apparatus be modified so as to be responsive to a signal received from a point-of-sale terminal or other device separate from the detaching apparatus. In such a case, data input for the point-of-sale terminal may be provided from a conventional bar code reader as is frequently done in retail operations.

Figure 9:
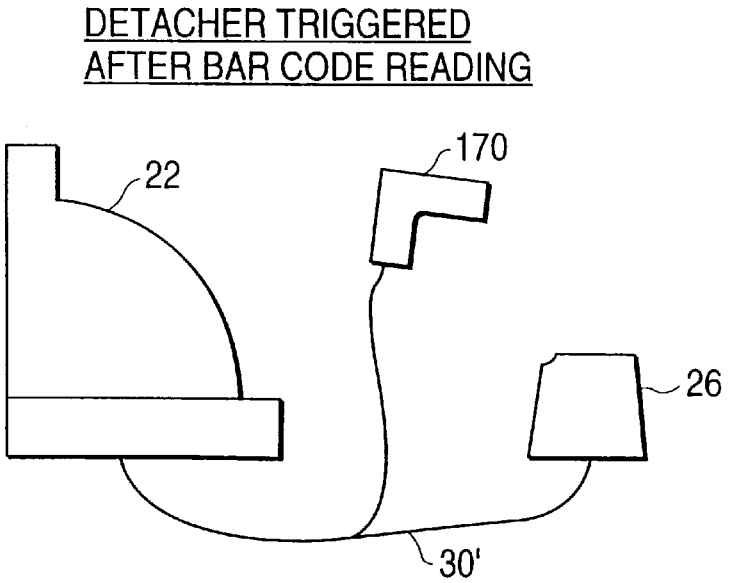
FIG. 9 is a schematic representation of equipment arranged at a checkout counter according to an aspect of the invention.

An installation according to this aspect of the invention is schematically illustrated in FIG. 9. FIG. 9 shows a point-of-sale terminal 22 connected via a Y-cable connection with a detaching device 26 and a bar code reading gun 170. Preferably the bar code reader 170 is a conventional device, and the point-of-sale terminal 22 also is conventional, and is driven by the bar code reader 170 in a customary manner, except that the point-of-sale terminal 22 also triggers the detaching device 26 so that the operations of the detaching device 26 are controlled through the point-of-sale terminal 22. The detaching device 26 may be like that shown in FIG. 5, or may lack the antenna 94, and the receive/transmit circuitry 96, and thus may lack any capability for transmitting product identification data to the point-of-sale terminal 22. In addition, the hard tags (not shown in the drawing) to be used with the installation of FIG. 9 need not include the RFID transponder referred to above and thus may be the same as conventional EAS hard tags.

In operating the installation of FIG. 9, a hard tag attached to an article of merchandise is placed in the nesting area of the detaching unit 26 and the bar code reader 170 is used to scan a bar code label attached to the article of merchandise separately from the hard tag. In response to the data read through the bar code reader 170, the point-of-sale terminal 22 processes a sales transaction and triggers the detaching device 26 to open the hard tag. Of course, if an invalid code or other irregularity is detected by the point-of-sale terminal 22, then it does not trigger the detaching unit 26 to remove the hard tag.

The article surveillance/product identification system of FIGS. 1–8 may be modified in other respects while still incorporating aspects of the invention. For example, the data writing capability described above may be omitted from the detaching device even though the identification data reading capability is retained. As another alternative, illustrated in FIG. 9A, a large part or all of the control circuitry, shown as integrated in the detaching unit in FIG. 5, may be provided in a separate module 172 connected between the detaching unit and the point-of-sale terminal. As seen from FIG. 9A, the module 172 is provided separately from a detaching unit 26'. The module 172 includes control and signal interface circuitry within a housing separate from and outside of the housing 82 of the detaching unit 26'. The housing of the module 172 is schematically indicated at 173 in FIG. 9A. Signal connections are provided between the control module 172 and the antenna 94 in the detacher unit 26' via a signal port 174 at the housing 82 of the detaching unit 26'. Additional signal ports 176 and 178 are also provided at the housing 82 of the detaching unit 26'. The port 176 is on a signal path from the tag detection switch 86 of the detaching unit 26' to the control module 172.

The signal port 178 is on a signal path from the module 172 to a motor drive circuit 180 in the detaching unit 26'.

Figure 9A:
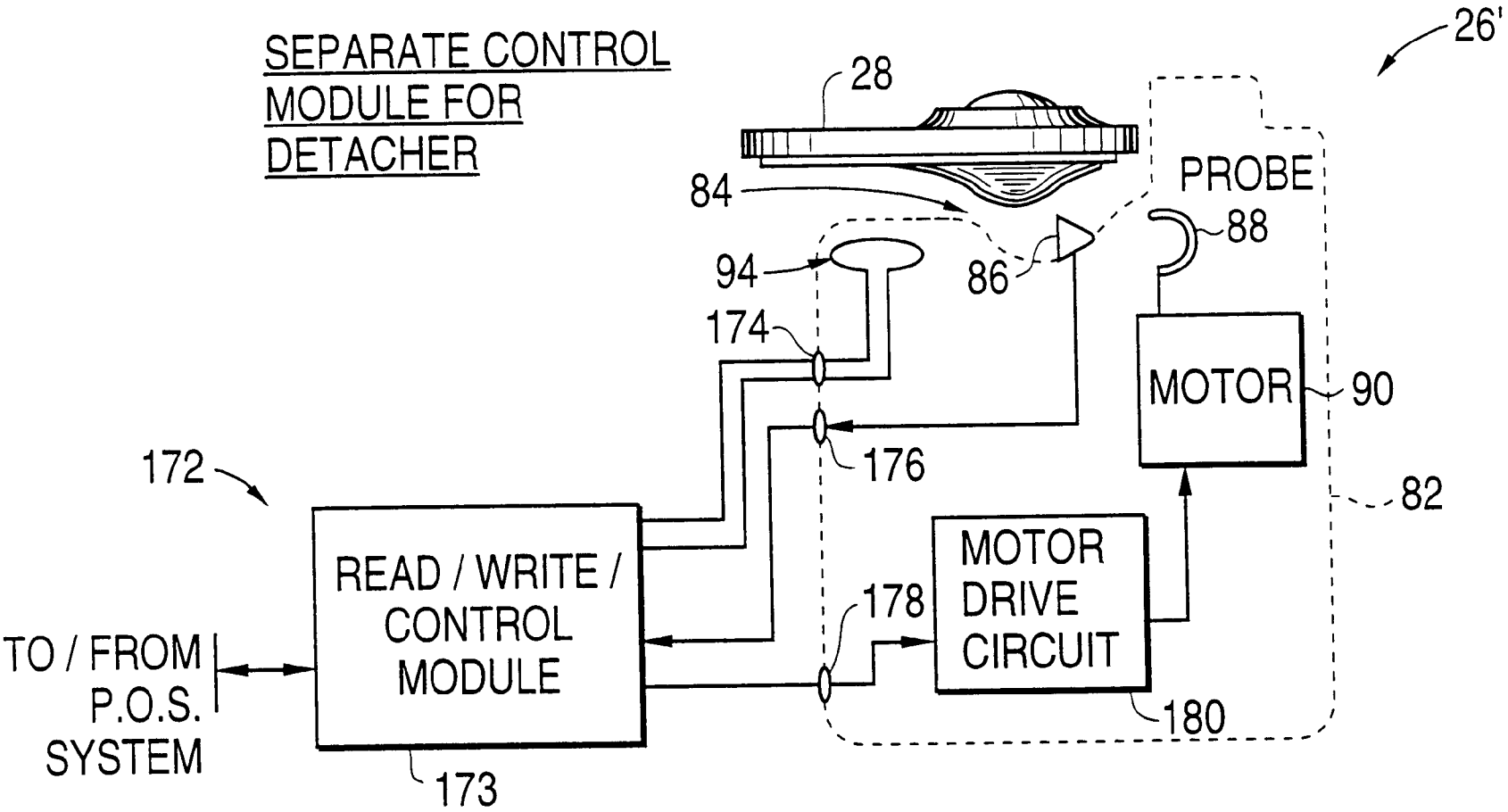
FIG. 9A schematically shows an alternative arrangement in which a tag detaching unit in accordance with the invention is interfaced to a point-of-sale terminal via a separate circuit module which controls operation of the detaching unit.

Although the arrangements shown in FIGS. 1, 9 and 9A indicate that wire communication connections are provided among the point-of-sale terminal, the detaching unit, the bar code reader (if present), etc., it is contemplated to replace one or more of the wire communication channels with a wireless data link or links.

Referring again to the programming unit 40 discussed in connection with FIG. 2, it should be noted that the detaching unit of FIG. 5 can be modified to constitute the programming unit by omitting the probe 88 and motor 90, while retaining the housing 82, antenna 94, receive/transmit circuit 46 (or transmit-only capability) and some or all of the RFID data transmission/receiving/communication functions of the control circuit 92.

Although the article surveillance and identification system of the invention has been described above primarily in connection with a retail store environment, it should be understood that the invention can be applied in other environments, including warehouses, offices, and hospitals, for example.

The detaching/data reading unit has been described as a modification of a known device that inserts a probe to release the tag from the article of merchandise. However, other types of release mechanisms may be employed without departing from the invention. As an example, a detaching mechanism which employs magnets to release a clutch in the tag may be used instead of the probe mechanism.

Further, it is contemplated to replace the tag detection switch 86 (FIG. 5) of the detaching unit with another type of device for detecting the presence of a tag at the detaching unit. One such device might be an optical or IR sensor.

Various other changes in structure to the described systems and apparatus and modifications in the described practices may be introduced without departing from the invention. Accordingly, it is to be understood that the particularly disclosed and depicted embodiments are intended in an illustrative and not in a limiting sense. The true spirit and scope of the invention are set forth in the following claims.

What is claimed is:

1. Detacher apparatus for removing an EAS tag from an article of merchandise, the EAS tag comprising a first element and a second element, the first and second elements adapted for assembly together by snap connection through the article of merchandise, the EAS tag further comprising release means for selectively releasing said snap connection, the detacher apparatus comprising:

a housing;

a movable probe, mounted in said housing, for selectively actuating said release means of the EAS tag to release said snap connection so that said first and second elements may be separated from each other to detach the EAS tag from the article of merchandise;

trigger means, in said housing, for receiving a trigger signal generated by a device that is separate from the detacher apparatus, said trigger means actuating movement of said probe in response to receiving the trigger signal; and means in said housing for receiving an identification signal generated by the EAS tag; and further comprising means for transmitting said identification signal from said housing to said device separate from the detacher apparatus.

2. Detacher apparatus according to claim 1, further comprising means in said housing for transmitting a data signal to the EAS tag.

3. Detacher apparatus according to claim 2, wherein said means for receiving the identification signal and said means for transmitting the data include an antenna in said housing.

4. Detacher apparatus for removing an EAS tag from an article of merchandise, the EAS tag comprising a first element and a second element, the first and second elements adapted for assembly together by snap connection through the article of merchandise, the EAS tag further comprising release means for selectively releasing said snap connection and transponder means for selectively providing a multibit identification signal, the detacher comprising:

a housing;

first means in said housing for indicating that an EAS tag is present at the housing;

second means, responsive to said first means, for generating an interrogation signal for stimulating said transponder means of the EAS tag to provide said multibit identification signal;

third means for receiving said multibit identification signal provided by said transponder means of the EAS tag; and fourth means, in said housing and responsive to said third means, for actuating said release means of the EAS tag to release said snap connection so that said first and second elements may be separated from each other to detach the EAS tag from the article of merchandise.

5. Detacher apparatus according to claim 4, wherein said transponder means includes means for receiving and storing a data signal, and said detacher apparatus further comprising fifth means for transmitting said data signal to said transponder means.

6. Detacher apparatus according to claim 5, further comprising antenna means in said housing and associated with said second, third and fifth means, for radiating said interrogation signal, for receiving said multibit identification signal, and for radiating said data signal.

7. Detacher apparatus according to claim 4, further comprising antenna means, in said housing and associated with said second and third means, for radiating said interrogation signal and for receiving said multibit identification signal.

8. Detacher apparatus according to claim 4, wherein said first element is a rigid label having a recessed hole, and said second element is a pin having a pointed member adapted to be engaged by said recessed hole, said first element having clamping means, associated with said release means, for releasably engaging said pointed member of said pin, said fourth means including probe means for being inserted into an aperture in said rigid label for mechanically actuating said release means to cause said clamping means to release said pin.

9. Detacher apparatus according to claim 4, wherein said interrogation signal generated by said second means is a continuous wave signal at substantially 13 MHz.

10. Detacher apparatus according to claim 4, wherein said third means includes a point-of-sale terminal provided outside of said housing and connected to said second means and said third means.

11. A detacher for removing a hard EAS tag from an article of merchandise, comprising:

a housing having a top surface and a nesting area in said top surface shaped for receiving the hard tag;

a switch at said nesting area for being mechanically actuated by a hard tag inserted into said nesting area;

an antenna in said housing for receiving an identification signal from a hard tag inserted into said nesting area;

separation means in said housing for inserting a probe into said hard tag to release clamping means in said hard tag;

a control circuit for controlling operation of aid separation means;

at least one signal port at said housing;

first means for providing a signal path between aid antenna and said at least one signal port; and second means for providing a signal path between aid at least one signal port and said control circuit.

12. A detacher according to claim 11, wherein said first and second means together include signal connections provided from said antenna to said control circuit and from said control circuit to said at least one signal port.

13. A detacher according to claim 11, wherein said antenna is located in said housing adjacent to said nesting area.

14. A detacher according to claim 11, wherein said separation means includes a motor controlled by said control circuit for providing pivoting movement to said probe.

15. A combined EAS/article identification tag, comprising:

an enclosure;

an attachment portion adapted for assembly together with said enclosure by snap connection through an article of merchandise;

a marker element, housed in the enclosure, for triggering an article surveillance system to generate an alarm signal; and an identification circuit in said attachment portion for generating a multibit radio frequency identification signal;

wherein said attachment portion is a tack having a head in which said identification circuit is lodged.

16. An electronic article surveillance and article identification system comprising, in combination:

a detection device, positioned at an exit of a retail store, for detecting unauthorized removal of goods from the retail store;

an identification signal reader at a checkout counter in the retail store, said identification signal reader for receiving via radio communication identifying information related to goods presented for purchase at the checkout counter, said identification signal reader including a point-of-sale terminal;

a plurality of reusable EAS/ID tags for being removably attached to goods on sale at the retail store, each of the EAS/ID tags including a marker element for triggering the detection device to generate an alarm signal and an identification element, separate from the marker element, for providing identifying information to the identification signal reader via radio communication; and a detacher device at the checkout counter for removing the EAS/ID tags from the goods presented for purchase;

said detacher device responding to a signal generated by said identification signal reader, said signal being generated by said identification signal reader in response to identification information provided by an identification element of one of the EAS/ID tags;

said identification signal reader including reading circuitry connected to the point-of-sale terminal and integrated in a housing with the detacher device.

* * * * *

UNITED STATES PATENT AND TRADEMARK OFFICE

CERTIFICATE OF CORRECTION

PATENT NO. : 5,955,951

DATED : September 21, 1999

INVENTOR(S) : Jerome Wischerop, et al.

It is certified that error appears in the above-identified patent and that said Letters Patent is hereby corrected as shown below:

Col. 5, line 54, after "hard" delete -- O --.
Col. 15, line 2, delete "aid" and insert -- said --.

Signed and Sealed this

Seventeenth Day of October, 2000

*Attest:*

Q. TODD DICKINSON

*Attesting Officer*

*Director of Patents and Trademarks*